US005195328A

United States Patent [19]

Davis

[11] Patent Number: 5,195,328

[45] Date of Patent: Mar. 23, 1993

[54] APPARATUS AND METHOD FOR HEATING A SPACE WITH WASTE HEAT

[76] Inventor: Owan W. Davis, Rte. 4, Box 47E, Ozark, Mo. 65721

[21] Appl. No.: 806,667

[22] Filed: Dec. 13, 1991

[51] Int. Cl.[5] ..... F25B 27/00

[52] U.S. Cl. ..... 62/117; 62/238.6; 237/2 B

[58] Field of Search ..... 237/2 B; 62/238.6, 513, 62/117

[56] References Cited

U.S. PATENT DOCUMENTS

| | | | |
|---|---|---|---|
| 4,263,785 | 4/1981 | Barniak et al. | 62/238.6 X |
| 4,321,797 | 3/1982 | Yaeger et al. | 62/238.6 X |
| 4,332,953 | 4/1982 | Ramlow et al. | 237/2 B X |
| 4,373,345 | 2/1983 | Tyree, Jr. et al. | 62/238.6 X |
| 4,537,045 | 8/1985 | Mayer | 62/513 X |
| 4,706,883 | 11/1987 | Fleischmann | 62/238.6 X |
| 4,955,207 | 9/1990 | Mink | 62/238.6 |

OTHER PUBLICATIONS

Mueller Fre-Heater, Paul Meuller Company, pp. 1, 3 and 6, Apr. 29, 1983, Springfield, Mo.

*Primary Examiner*—William E. Tapolcai

*Attorney, Agent, or Firm*—Senniger, Powers, Leavitt & Roedel

[57] ABSTRACT

An apparatus for heating a space using waste heat from a biologically heated product, the apparatus including a storage tank for storing a quantity of the milk and a heat exchanger in thermal communication with the product carrying a thermally conductive fluid. The fluid absorbs heat from the milk and cools the milk as it flows through the heat exchanger. A first condenser in fluid communication with the heat exchanger and carries fluid heated by the milk therein. A fan forces air over the first condenser, heating the air and cooling the fluid in the first condenser. The fan forces the heated air into the space to be heated.

A method for recovering waste heat from a biologically heated product is also disclosed.

13 Claims, 2 Drawing Sheets

APPARATUS AND METHOD FOR HEATING A SPACE WITH WASTE HEAT

BACKGROUND OF THE INVENTION

The present invention relates generally to space heating apparatus and more particularly to such apparatus utilizing waste heat removed from a biological product such as milk.

Milk taken from cows has a significant heat content which must be removed to prevent spoilage and to maintain quality. In order to sell the milk as Grade A, its temperature must be lowered approximately 50° F. Stated another way, for a typical dairy cow, approximately 2,500 Btu of heat must be removed from the milk it produces each day. To accomplish this, large refrigeration systems are used to extract heat from the milk which is taken from several cows and then stored in large tanks. In a large dairy operation, storage tanks hold 6,000 gallons of milk having a heat content of about 2,500,000 Btu which must be removed each day. There is presently a need for a system which recovers and makes use of the waste heat of the milk.

SUMMARY OF THE INVENTION

Among the several objects of this invention may be noted the provision of an apparatus which absorbs heat generated by a biologically heated product, such as milk, and uses the energy to heat a large space like a dairy barn; the provision of such an apparatus which is selectively and automatically operable to heat the barn while continuously cooling the milk; and the provision of such an apparatus which is cost effective and helps to preserve natural resources. Also among the several objects of this invention may be noted the provision of a method for recovering waste heat from a biologically heated product, such as milk, which removes the heat from the milk and heats a large space such as a dairy barn.

Generally, an apparatus constructed according to the principles of the present invention comprises means for storing a quantity of milk, and a thermally conductive fluid in a heat exchanger adapted for thermal communication with the milk. The fluid in the heat exchanger absorbs heat from the milk, thereby cooling the milk. A first condenser adapted for fluid communication with the heat exchanger carries fluid heated by the milk therein. Blower means forces air over the first condenser thereby heating the air and cooling the fluid in the first condenser. The blower means forces the heated air into the space to be heated.

A method for recovering waste heat from a biologically heated product, such as milk, according to the present invention comprises the steps of storing a quantity of biologically heated milk in a storage vessel. Heating a first fluid by placing it in thermal communication with the milk so that thermal energy is transferred from the milk to the first fluid thereby cooling the milk. The first fluid is compressed and drawn from where it is heated and passed to where the heat is removed from the fluid. Heat is removed from the first fluid by bringing a second fluid into thermal communication with the first fluid. The second fluid is then forced into the space to be heated.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
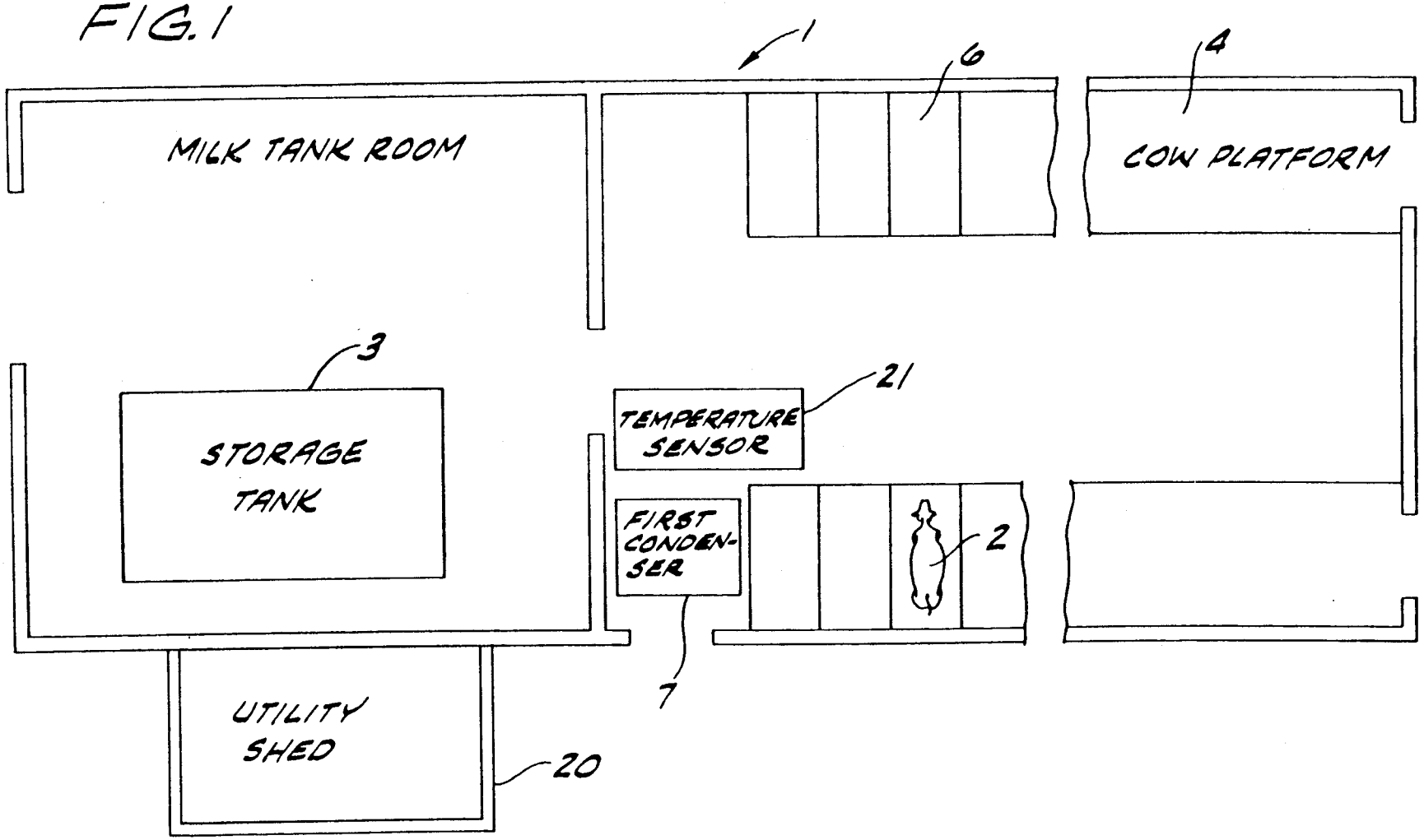
FIG. 1 is a top plan of the present invention in its working environment.

Referring now to the drawings, a dairy facility is shown to include an apparatus for heating a space, such as a dairy barn, indicated generally at 1, with heat recovered from a biological product such as milk taken from a cow, such as cow 2. The apparatus comprises a storage tank 3 for storing a quantity of milk, a heat exchanger 5 or evaporator having a thermally conductive fluid flowing therein which removes the heat from the milk, and a first condenser 7 which removes the heat from the thermally conductive fluid. A fan (broadly "blower means") 9 forces air over the first condenser 7, where it is warmed, and into the dairy barn.

Storage tank 3 preferably is capable of receiving and storing at least the quantity of milk generated each day from fifty cows producing approximately 2,500 gallons of milk a day (FIG. 1). Typically, automated milking equipment of the type well known in the art is used to extract the milk from the cows and transfer it to the tank. The milking operation takes place on a cow platform 4 having a plurality of cow stalls 6. The milk taken from the cow is at a substantially greater temperature then the temperature required for the milk to be considered Grade A quality. In order to be considered Grade A milk, the milk must be lowered to a temperature below 38° Fahrenheit. To lower the temperature of the milk, a heat exchanger 5 or an evaporator for absorbing the heat from the milk is located inside the tank in thermal communication with the milk. Evaporator 5 comprises a coiled conduit having a large surface area running through the storage tank. Flowing through the conduit is a thermally conductive fluid or refrigerant such as Freon R-22 which absorbs the heat from the warm milk. The refrigerant passes through a sub-cooling valve 11, located upstream from evaporator 5, and is thereafter at a relatively low pressure so that the refrigerant absorbs heat from the milk as it passes from a liquid-vapor state to a generally saturated vapor state in the evaporator.

In fluid communication with the evaporator 5 is a refrigerant accumulator 13 or reservoir holding a quantity of refrigerant in both liquid and vapor states. A compressor 15 in fluid communication with the accumulator 13 draws away the saturated vaporous refrigerant from the accumulator. Compressor 15 compresses the refrigerant and passes the fluid through a solenoid valve 17 which is selectively operable to direct the refrigerant to the first condenser 7, or to a second condenser 19. Valve 17 is a modified heat pump reversing valve manufactured by Ranco Valve, model no. V-26, Plain City, OH. The sub-cooling valve 11, accumulator 13, compressor 15, valve 17 and second condenser 19 are each located in a utility shed 20 adjacent barn 1.

Figures 2, 3:
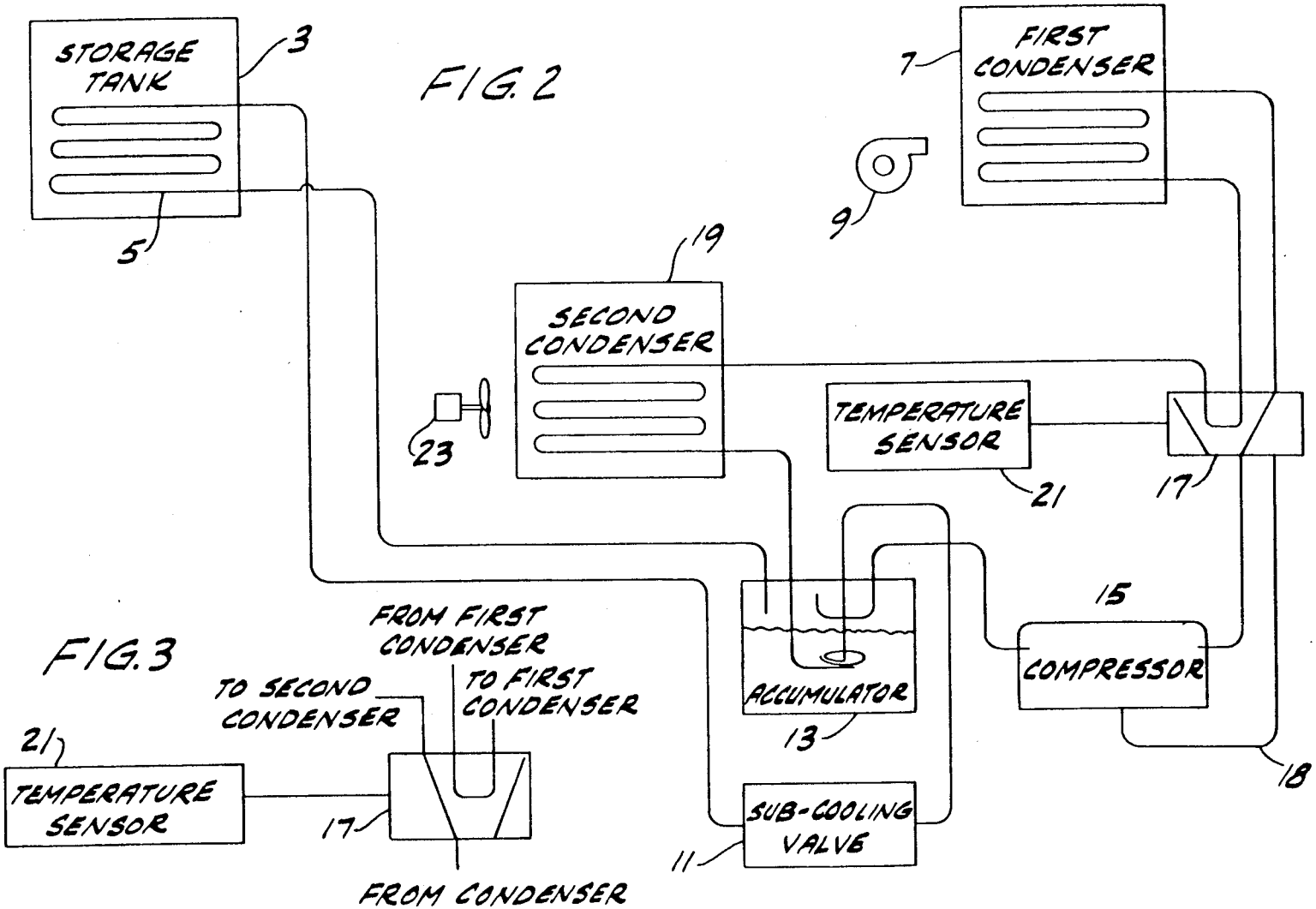
FIG. 2 is a schematic representation of an apparatus for heating a space with heat recovered from a biologically produced product, the schematic representing the flow of a thermally conductive fluid flowing to a first condenser.
FIG. 3 is a schematic representation of a valve diverting the thermally conductive fluid to a second condenser.

As previously stated, valve 17 is a modified heat pump reversing valve adapted to divert the flow of heated fluid from the first condenser 7 to the second condenser 19. The valve 17 operates by using a partial vacuum drawn by the compressor 15. Therefore, the valve has a line 18 leading back to the low pressure side of the compressor 15. As shown in the schematic drawing FIG. 2, the valve 17 is in a first position for flow from the compresser to the first condenser. Upon activation, the valve moves to a second position to divert the flow of heated fluid to the second condenser (see FIG. 3), and blocks flow from the compressor to the first condenser.

A temperature sensor 21 senses the ambient temperature in the barn. When the temperature in the barn is above a predetermined value, the temperature sensor 21 generates a signal to which the solenoid valve 17 is responsive to move to the second position in which fluid communication from the valve to the first condenser 7 is blocked, and fluid passes from the compresser 15 to the second condenser 19. Heat removed from the fluid in the second condenser 19 is exhausted to the outside by a fan 23 so the barn is not heated. Thus, the first condenser 7 is bypassed when the ambient temperature of the barn is above the predetermined temperature. If ambient temperature in the barn falls below the predetermined temperature, the solenoid valve 17 is responsive to such an indication from the sensor 21 to move the valve to the first position in which fluid communication from the valve 17 to the second condenser 19 is blocked, and fluid passes from the compresser 15 to the first condenser 7. The fan 9 blows cool, ambient air over the convolutions of the first condenser 7 and the air absorbs the heat given off as the refrigerant condenses. The warmed air is then forced into the barn by the fan 9, and heats the barn. The cooled fluid flows from the first condenser 7 to the second condenser 19 for removing more heat before the cycle begins again. Refrigerant from the second condenser 19 flows through a return conduit containing the sub-cooling valve 11, and back to the first heat exchanger 5. The return conduit passes through the accumulator 13, and has a coiled portion 14 located in the bottom of the accumulator so that remaining heat in the refrigerant can be recovered to heat the refrigerant in the accumulator. In this regard, accumulator 13 works like a heat exchanger. In its preferred embodiment, apparatus 1 is capable of heating an extremely large space holding 600–1000 cows.

The modified refrigeration system described thusfar is taken from a Mueller Hi-Per-Form System manufactured by Paul Mueller of Springfield, MO. This system includes a sub-cooling valve in place of an expansion valve along with a heat-exchange accumulator in place of a standard accumulator. Significantly, valve 17, first condenser 7 and temperature sensor 21 have been added to the above described system. Therefore, this new and unique system now directs the flow of heated refrigerant to the first condenser 7 or to the second condenser 19, depending upon the temperature in the barn. However, it is to be understood that other dairy refrigeration systems may be used in place of the Hi-Per-Form System and still fall within the scope of the present invention.

In operation, the apparatus operates to heat a space, such as room in the barn, using thermal energy recovered from a biologically heated product, such as milk. First, warm milk taken from cows is pumped to and stored in a storage vessel 3 such as the milk storage tank. A refrigerant flowing through the heat exchanger 5 is placed into thermal communication with the milk such that thermal energy is transferred from the milk to the refrigerant, thereby cooling the milk and heating the refrigerant. Prior to entering the first heat exchanger 5, the refrigerant passes through a sub-cooling valve 11 so that the refrigerant is at a low pressure in the heat exchanger 5 which facilitates heat absorption. The heated refrigerant flows to the accumulator 13 and the compressor 15 draws off gaseous refrigerant, raises its pressure and feeds it to the solenoid valve 17.

The temperature sensor 21 senses the ambient temperature of the room and activates the valve 17 to divert the heated fluid from the compressor 15 to the second condenser 19 thus bypassing the first condenser 7 when the ambient temperature of the room is above a predetermined value. If the temperature of the space to be heated is below the predetermined temperature, the valve 17 directs the heated refrigerant to the first condenser 7. The fan 9 blows air over the first condenser 7 for cooling the fluid flowing therein and heating the air. The fan further forces the air into the room to be heated. Upon leaving the first condenser 7, the fluid enters the second condenser 19 where more heat is removed. The conduit transporting the fluid from the second condenser passes through the accumulator 13, where the fluid in the conduit is in thermal communication with the fluid in the accumulator. The fluid in the conduit then passes through the sub-cooling valve 11 and into the heat exchanger 5 and the cycle is repeated.

In view of the above, it will be seen that the several objects of the invention are achieved and other advantageous results attained.

As various changes could be made in the above constructions without departing from the scope of the invention, it is intended that all matter contained in the above description as shown in the accompanying drawing shall be interpreted as illustrative and not in a limiting sense.

What is claimed is:

1. Apparatus for heating a space in which mammals are located with waste heat from a biological product from the mammals such as milk, the apparatus comprising;

means for storing a quantity of the milk;

a thermally conductive fluid;

a heat exchanger disposed for thermal communication with the milk in said storing means, said heat exchanger having the fluid flowing therethrough, the fluid absorbing heat from the milk and cooling the milk as it flows through the heat exchaner;

a first condenser adapted for fluid communication with the heat exchanger for carrying fluid heated by the milk therein;

first blower means for forcing air over the first condenser thereby heating the air and cooling the fluid in the first condenser, said blower means being disposed for forcing the heated air into the space to be heated;

valve means in fluid communication with the heat exchanger;

a second condenser adapted for fluid communication with said valve means and said first condenser, second blower means for forcing air over the first condenser thereby heating the air and cooling the fluid in the second condenser, said second blower means being disposed for forcing the heated air to the atmosphere outside the space to be heated;

said valve means being selectively movable between a first position in which fluid flows generally from the heat exchanger, through said valve means to said fist condenser, from said first condenser back to said valve means, thence to said second condenser and returns to the heat exchanger, and a second position in which fluid flows generally from the heat exchanger through said valve means to said second condenser, bypassing said first condenser, and returns to the heat exchanger.

2. An apparatus as set forth in claim 1 herein the first condenser comprises a coiled conduit for carrying fluid heated by the milk, and wherein said first blower means comprises a fan for forcing air over the coiled conduit thereby heating and forcing the air into the space to be heated.

3. An apparatus as set forth in claim 2 further comprising a compressor in fluid communication with the heat exchanger and said valve means, the compressor being adapted to raise the pressure of the fluid.

4. An apparatus as set forth in claim 3 further comprising an accumulator holding a quantity of fluid, the accumulator being in fluid communication with the heat exchanger and the compressor.

5. An apparatus as set forth in claim 4 further comprising conduit means for transporting fluid from the second condenser to the heat exchanger, said conduit means including a coiled portion located generally in the bottom of the accumulator, fluid in the coiled portion being in thermal communication with fluid in the accumulator.

6. An apparatus as set forth in claim 5 further comprising temperature sensing means for sensing the ambient temperature of the space to be heated, said valve means being responsive to said sensing means for moving from said first position to said second position when the ambient temperature of the space to be heated is above a predetermined value.

7. A dairy facility comprising:

a building having at least one room in which cows are milked;

means for storing the milk taken from the cows;

a thermally conductive fluid;

a heat exchanger disposed for thermal communication with he milk in said storing means, said heat exchanger having the fluid flowing therethrough, the fluid absorbing heat from the milk and cooling the milk as it flows through the heat exchanger;

a first condenser adapted for fluid communication with the heat exchanger for carrying fluid heated by the milk therein;

first blower mean for forcing air over the first condenser thereby heating the air and cooling he fluid in the first condenser, said blower means being disposed for forcing the heated air into the room;

temperature sensing means for sensing he ambient temperature of the room;

valve means in fluid communication with the heat exchanger, said valve means being responsive to said sensing means;

a second concenser adapted for fluid communication with said valve means and said first condenser;

second blower means for forcing air over the second condenser thereby heating he air and cooling the fluid in the second condenser, said second blower means being disposed for forcing the heated air outside the building;

said sensing means being operable upon detection of a temperature generally at or below a predetermined value to cause said valve means to move to a first position in which fluid glows generally from the heat exchanger through said valve means to said first condenser, from said first condenser back to said valve means, thence to said second condenser and returns to the heat exchanger, and said sensing means being operable upon detection of a temperature generally above a predetermined value to cause said valve means to move to a second position such that fluid flows generally from the heat exchanger through said valve means to said second condenser, bypassing said first condenser, and returns to the heat exchanger.

8. A dairy facility as set forth in claim 7 wherein the first condenser comprises a coiled conduit for carrying fluid heated by the milk and said fist blower means comprises a fan of forcing air over the coiled conduit thereby heating and forcing he air into the room.

9. A dairy facility as set forth in claim 7 further comprising a compressor in fluid communication with the heat exchanger and said valve means, the compressor being adapted to raise the pressure of the fluid.

10. A dairy facility as set forth in claim 9 further comprising an accumulator holding a quantity of fluid, the accumulator being in fluid communication with the heat exchanger and the compressor.

11. A method for heating a space, such as room in a building, using thermal energy recovered from a biologically heated produce such as milk, the method comprising the steps of:

extracting a quantity of milk from mammals located in the room;

storing the milk in a storage vessel;

heating a first fluid in a heat exchanger by placing it in thermal communication with the milk such that thermal energy is transferred from the milk to the first fluid thereby cooling the milk;

transporting the heated first fluid from the heat exchanger to a valve;

sensing the ambient temperature of he space to be heated;

removing heat from the first fluid in a first condenser by bringing a second fluid into thermal communication with the first fluid;

forcing the heated second fluid into the room;

diverting the fluid with the valve form said first condenser to a second condenser when the ambient temperature of the room is above a predetermined temperature;

removing heat form the firs fluid i said second condenser by bringing the second fluid into thermal communication with the firs fluid;

forcing the heated second fluid to the atmosphere outside the room.

12. A method as set forth in claim 11 wherein the step of transporting the first fluid from the heat exchanger to the first condenser comprises the steps of:

transporting the heated first fluid from the heat exchanger to an accumulator;

compressing the first fluid drawn off from the accumulator; and transporting first fluid from the compressor to the first condenser.

13. A method as set forth in claim 12 further comprising, subsequent to the step of removing heat from the first fluid in the first condenser, the steps of:

placing the first fluid transported from the second condenser in thermal communication with the first fluid in the accumulator.

* * * * *